US005494075A

United States Patent [19]

Moore

[11] Patent Number: 5,494,075

[45] Date of Patent: Feb. 27, 1996

[54] HYDRAULIC TIME DELAY VALVE

[75] Inventor: Walter J. Moore, Huntington, N.Y.

[73] Assignee: Northrop Grumman Corporation, Los Angeles, Calif.

[21] Appl. No.: 262,615

[22] Filed: Jun. 20, 1994

[51] Int. Cl.[6] ..... F15B 13/042; F15B 21/10

[52] U.S. Cl. ..... 137/625.6; 91/38; 251/63.4; 92/130 R

[58] Field of Search ..... 91/38, 443, 130 R, 91/168, 169.1; 137/625.6; 251/63.4, 63.6, 25

[56] References Cited

U.S. PATENT DOCUMENTS

| | | | |
|---|---|---|---|
| 2,807,238 | 9/1957 | Pilch | 91/38 |
| 2,922,432 | 1/1960 | Huntinton et al. | 137/513.7 X |
| 2,986,368 | 5/1961 | Moore | 251/25 X |
| 3,131,722 | 5/1964 | Abbott et al. | 137/625.6 |
| 3,147,671 | 9/1964 | Geyer | 92/168 X |
| 3,253,516 | 5/1966 | Huntington et al. | 137/625.64 X |
| 3,543,643 | 12/1970 | Southwell | 92/169.1 X |
| 3,896,852 | 7/1975 | Holmes | 91/38 X |

*Primary Examiner*—Gerald A. Michalsky
*Attorney, Agent, or Firm*—Terry J. Anderson; Karl J. Hoch, Jr.

[57] ABSTRACT

A hydraulic time delay valve includes a hydraulic timer valve having a valve pressure port, a valve return port, a valve cylinder port and a porting device for porting hydraulic fluid from the valve pressure port to the valve cylinder port. A cylinder is coupled to the timer valve and has a cylinder return port and an opening port at the bottom. A piston in the cylinder is axially movable from a depressed position in which the piston blocks the opening of the cylinder to an extended position in which the piston frees the opening. A control applies hydraulic fluid under pressure to the opening. The control includes a fluid restricting device for restricting fluid flowing to the opening. Thus, hydraulic fluid applied under pressure to the valve pressure port depresses the piston to its depressed position and hydraulic fluid applied under pressure via the control is restricted by the fluid restricting device for a period of time determined by a desired time delay. The hydraulic fluid then flows through the open port and extends the piston against the force of return hydraulic fluid supplied under pressure to the cylinder return port. After the lapse of the period of time, the piston activates the porting device, thereby causing hydraulic fluid to port from the valve pressure port to the valve cylinder port to provide high pressure hydraulic fluid flow to a hydraulic device coupled to the valve cylinder port.

6 Claims, 2 Drawing Sheets

HYDRAULIC TIME DELAY VALVE

BACKGROUND OF THE INVENTION

1. Field of the Invention

The present invention relates to a time delay valve. More particularly, the invention relates to a hydraulic time delay valve.

Hydraulic assemblies known in the art rely upon electrical devices to provide a hydraulic time delay sequence. These electrical devices include solenoids and time delay relays, as well as associated electrical wiring. The solenoids and relays require electrical power for operation.

The principal object of the invention is to provide a hydraulic time delay valve which provides a hydraulic time delay sequence without the use of solenoids or relays.

An object of the invention is to provide a hydraulic time delay valve which functions efficiently, effectively and reliably to provide a hydraulic time delay sequence.

Another object of the invention is to provide a hydraulic time delay valve of relatively simple structure, which functions efficiently, effectively and reliably without solenoids or relays to provide a hydraulic time delay sequence.

Still another object of the invention is to provide a hydraulic time delay valve of simple structure for controlling a hydraulic device with efficiency, effectiveness and reliability.

Yet another object of the invention is to provide a hydraulic time delay valve which is usable with convenience and facility to control hydraulic devices such as earth moving machinery, conveyor belts, automated machinery, industrial assembly line equipment and hydraulic presses.

BRIEF SUMMARY OF THE INVENTION

In accordance with the invention, a hydraulic time delay valve assembly comprises a hydraulic timer valve having a valve pressure port, a valve return port, a valve cylinder port and porting means for porting hydraulic fluid from the valve pressure port to the valve cylinder port. A cylinder coupled to the timer valve has a return port and an opening at the bottom. A piston in the cylinder is axially movable from a depressed position, in which the piston blocks the opening of the cylinder, to an extended portion in which the piston frees the opening. Control means applies hydraulic fluid under pressure to the opening and restricts fluid flowing to the opening. Thus, hydraulic fluid applied under pressure via the control means is restricted for a period of time determined by a desired time delay and then flows to the opening and extends the piston from its depressed position and, after the lapse of the period of time, the piston activates the porting means of the timer valve thereby causing hydraulic fluid to port from the valve pressure port to the valve cylinder port to provide high pressure hydraulic fluid flow to a hydraulic device coupled to the valve cylinder port.

In accordance with the invention, a hydraulic time delay valve comprises a hydraulic timer valve having a valve pressure port, a valve return port, a valve cylinder port and porting means for porting hydraulic fluid from the valve pressure port to the valve cylinder port. A cylinder coupled to the timer valve has a cylinder return port and an opening at the bottom. A piston in the cylinder is axially movable from a depressed position in which the piston blocks the opening of the cylinder to an extended position in which the piston frees the opening. Control means applies hydraulic fluid under pressure to the opening, the control means including fluid restricting means restricts fluid flowing through the opening. Thus, hydraulic fluid, applied under pressure to the valve opening port, depresses the piston to its depressed position and hydraulic fluid, applied under pressure via the control means, is restricted by the fluid restricting means for a period of time determined by a desired time delay and then flows to the opening and extends the piston against the force of return hydraulic fluid supplied under pressure to the cylinder return port. After the lapse of the period of time, the piston activates the porting means thereby causing the hydraulic fluid to port from the valve pressure port to the valve cylinder port to provide high pressure hydraulic fluid flow to a hydraulic device coupled to the valve cylinder port.

In accordance with the invention, a hydraulic time delay valve comprises a hydraulic timer valve having a valve pressure port, a valve return port, a valve cylinder port and porting means including a depressible valve stem extending therefrom for porting hydraulic fluid from the valve pressure port to the valve cylinder port. A cylinder has an axis coaxial with the valve stem and is coupled to the timer valve in a manner whereby the valve stem extends into the cylinder. The cylinder has a cylinder return port and an open bottom. A piston in the cylinder is axially movable from a depressed position in which the piston blocks the open bottom of the cylinder to an extended position in which the piston frees the open bottom. The piston has a piston stem in coaxial alignment with the valve stem. A spring is coaxially positioned around the piston stem in the piston for forcing the piston to its depressed position. A substantially cylindrical end cap accommodates the lower portion of the cylinder and has a cap open port and a channel extending through the end cap from the cap open port to the open bottom cavity. A directional flow control valve in the channel restricts fluid flowing from the cap open port to the open port bottom cavity. Thus, hydraulic fluid applied under pressure to the valve open port depresses the piston to its depressed position and hydraulic fluid applied under pressure to the cap open port is restricted by the directional flow control valve for a period of time determined by a desired time delay and then flows through the channel to the open bottom cavity and extends said piston against the force of the spring and against the force of return hydraulic fluid supplied under pressure to the cylinder return port. After the lapse of the period of time, the piston stem contacts the valve stem thereby causing hydraulic fluid to port from the valve pressure port to the valve cylinder port to provide high pressure hydraulic fluid flow to a hydraulic device coupled to the valve cylinder port. The piston has a base portion and a first cylindrical portion extending from the base portion and coaxial with the cylinder for accommodating the spring. The end cap has a base member and a cylindrical projection extending from the base member coaxial with and surrounding part of the cylinder. The base member of the end cap has a flange for mounting the hydraulic time delay valve assembly. The cylinder has a top and a second cylindrical portion extending from the top coaxial with the cylinder and into the first cylindrical portion in spaced relation with the first cylindrical portion. The spring is positioned around the second cylindrical portion and within the first cylindrical portion.

Two backup rings and one O-ring are provided between the base portion of the piston and the cylinder and two backup rings and one O-ring are provided between the cylinder and the cylindrical projection of the end cap. A lock ring is provided around the cylinder and the cylindrical projection of the end cap on the cylindrical projection., Two backup rings and one O-ring are provided between the piston stem and the second cylindrical portion of the cylinder.

In accordance with the invention, a method of providing a hydraulic time delay comprises the steps of applying hydraulic fluid under pressure to the pressure port of a hydraulic timer valve, mounting a piston in a cylinder, and urging the piston to a depressed position in the cylinder. The flow of hydraulic fluid applied under pressure to the cylinder port is restricted for a period of time determined by a desired time delay, thereby delaying movement of the piston by the hydraulic fluid flow to the cylinder for the period of time. Hydraulic fluid is ported from the pressure port of the hydraulic timer valve to a cylinder port of the timer valve due to movement of the piston after the lapse of the period of time, thereby providing high pressure hydraulic fluid flow to a hydraulic device coupled to the cylinder port.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
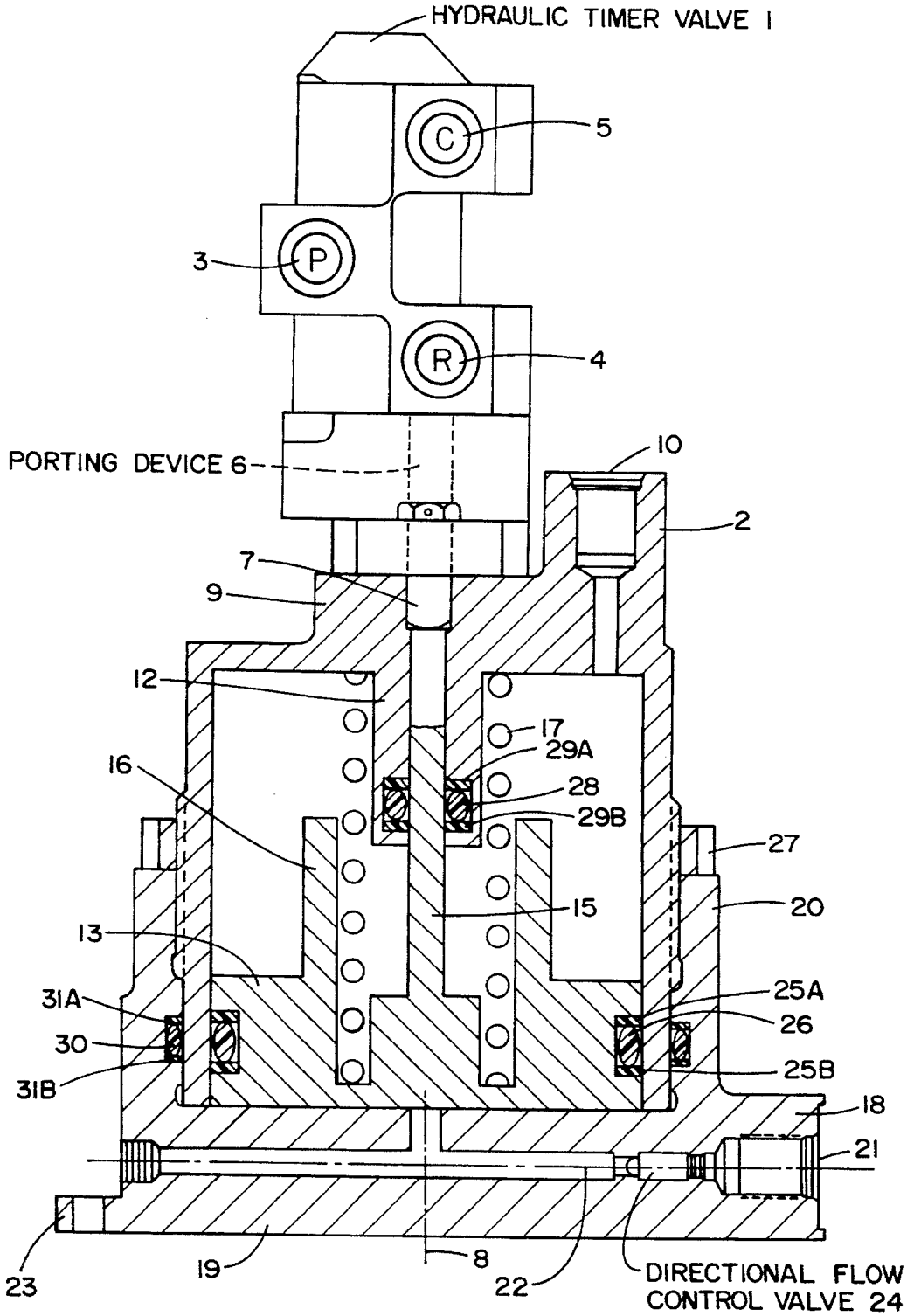
FIG. 1 is a view, partly in section, of an embodiment of the hydraulic time delay valve of the invention, in non-actuated condition.
Figure 2:
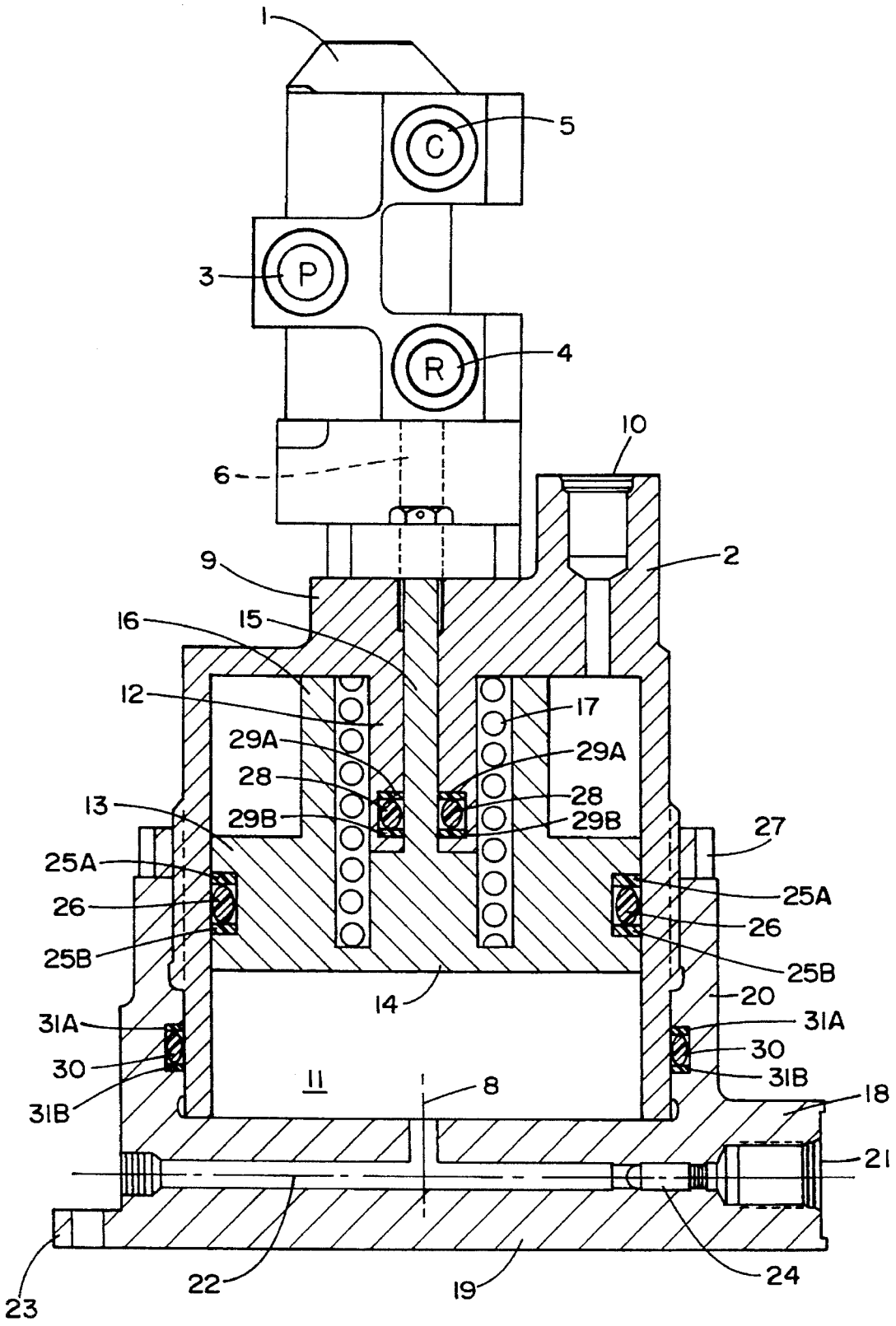
FIG. 2 is a view, partly in section, of the embodiment of FIG. 1, in actuated condition.

Turning now in detail to the drawings, the hydraulic time delay valve of the invention, shown in FIGS. 1 and 2, consists of a hydraulic timer valve 1 mounted on top of a cylinder 2. The timer valve 1 has a valve pressure port 3, a valve return port 4, and a valve cylinder port 5. The timer valve 1 also has a porting device 6 which includes a depressible valve stem 7 (FIG. 1) extending from said porting device for porting hydraulic fluid from the valve pressure port 3 to the valve cylinder port 5.

The cylinder 2 has an axis 8 coaxial with the valve stem 7 and is coupled to the timer valve 1 in a manner whereby said valve stem extends into said cylinder. The cylinder 2 has a top 9 with a cylinder return port 10 therein and an open bottom cavity 11 (FIG. 2). A cylindrical portion 12 of the cylinder 2 extends into said cylinder from the top 9 coaxially with said cylinder.

A piston 13 in the cylinder 2 is axially movable from a depressed position in which said piston blocks the open bottom 11 of said cylinder, as shown in FIG. 1, to an extended position in which said piston frees said open bottom, as shown in FIG. 2. The piston 13 has a base portion 14 and a piston stem 15 extending from said base portion in coaxial alignment with the valve stem 7. The piston 13 also has a cylindrical portion 16 extending from its base portion 14 and coaxial with the cylinder 2. The cylindrical portion 12 of the cylinder 2 extends into the cylindrical portion 16 of the piston 13 in spaced relation with the cylindrical portion of said piston.

A spring 17 is accommodated in the space between the cylindrical portions 12 and 16, positioned coaxially around the cylindrical portion 12 and within the cylindrical portion 16. The spring 17 functions to force the piston 13 to its depressed position (FIG. 1).

A substantially cylindrical end cap 18 accommodates the lower portion of the cylinder 2. The end cap 18 has a base member 19 and a cylindrical projection 20 extending from said base member coaxial with and surrounding part of the cylinder 2. The end cap 18 has a cap open port 21 in the base member 19 thereof and a channel 22 extending through said base member from said cap pressure port to the open bottom 11 of the cylinder 2. The base member 19 of the end cap 18 has a flange 23 for mounting the hydraulic time delay valve of the invention.

A directional flow control valve 24 of any suitable known type such as, for example, a Lee directional flow control valve, is provided in the channel 22 of the end cap 18 for restricting fluid flowing from the cap open port 21 to the open bottom 11 of the cylinder 2.

Two backup rings 25A and 25B and O-ring 26 are provided between the base portion 14 of the piston 13 and the cylinder 2. A second set of backup rings 31A and 31B and O-ring 30 are provided between the cylinder 2 and the cylindrical projection 20 of the end cap 18. A lock ring 27 is placed around the cylinder 2 and the cylindrical projection 20 of the end cap 18 on said cylindrical projection. An O-ring 28 and two backup rings 29A and 29B are provided between the piston stem 15 and the cylindrical portion 12 of the cylinder.

Hydraulic fluid applied under return pressure to the valve return port 10 in conjunction with spring 17 depresses the piston 13 to its depressed position, as shown in FIG. 1. Hydraulic fluid applied under pressure to the cap open port 21 is restricted by the directional flow control valve 24 for a period of time determined by a desired time delay and then flows through the channel 22 to the open bottom 11 of the cylinder 2. The fluid extends or raises the piston 13 against the force of the spring 17 and against the force of return hydraulic fluid supplied under pressure to the cylinder return port 10. After the lapse of the period of time during which the flow of hydraulic fluid supplied to the cap open port 21 is restricted, the piston stem 15 contacts the timer valve stem 7 and moves said valve stem into the hydraulic timer valve 1 (FIG. 2). This operates the porting device 6 to cause hydraulic fluid to port from the valve pressure port 3 to the valve cylinder port 5 to provide high pressure hydraulic fluid flow to a hydraulic device such as, for example, a hydraulic liner actuator, rotary actuator, or any suitable hydraulic device which requires actuation or control. The hydraulic device is extended or retracted by the hydraulic fluid applied thereto under a pressure of up to 3000 psig.

When high pressure hydraulic fluid is removed from the cap open port 21, the piston 13 instantly retracts, pushing the remaining hydraulic fluid free flow through the directional flow control valve 24. The hydraulic timer valve 1 resets to its initial non-actuated position, thereby blocking the valve pressure port 3 and connecting the valve cylinder port 5 to return port 4.

The method of the invention for providing a hydraulic time delay comprises the step of applying hydraulic fluid under pressure to the pressure port 3 and cap open port 21 of the hydraulic timer valve 1 and mounting the piston 13 in the cylinder 2. The piston 13 is urged to a depressed position in the cylinder 2. The flow of hydraulic fluid applied under pressure to the cylinder 2 via the cap open port 21 is restricted for a period of time determined by a desired time delay. This delays movement of the piston 13 by the hydraulic fluid flow to the cylinder 2 in cavity 11 for the determined period of time. Hydraulic fluid from the pressure port 3 of the hydraulic timer valve 1 is ported to the cylinder port 5 of said hydraulic timer valve due to movement of the piston 13 after the lapse of the determined period of time, thereby providing high pressure hydraulic fluid flow to a hydraulic device coupled to said cylinder port.

While only a single embodiment of the present invention has been shown and described, it is to be understood that many changes and modifications may be made thereunto without departing from the spirit and scope of the invention as defined in the appended claims.

What is claimed is:

1. A hydraulic time delay valve, comprising:

a hydraulic timer valve having a valve pressure port, a valve return port, a valve cylinder port and porting means including a depressible valve stem extending therefrom for porting hydraulic fluid from the valve pressure port to the valve cylinder port;

a cylinder having an axis coaxial with the valve stem and coupled to the timer valve in a manner whereby said valve stem extends into said cylinder, said cylinder having a cylinder return port and an open bottom port;

a piston in said cylinder axially movable from a depressed position in which the piston blocks the open bottom port of said cylinder to an extended position in which said piston frees said open bottom, said piston having a piston stem in coaxial alignment with the valve stem;

a spring coaxially positioned around said piston stem in said piston for forcing said piston to its depressed position;

a substantially cylindrical end cap having a bottom surface and a cylindrical projection extending from said bottom surface accommodating the lower portion of said cylinder and having a cap open port and a channel extending through the end cap from the cap open port to said open bottom;

said piston having a base portion and a first cylindrical portion extending from the base portion and coaxial with said cylinder for accommodating said spring and said end cap having a base member and a cylindrical projection extending from the base member coaxial with and surrounding part of said cylinder; and a directional flow control valve in the channel for restricting fluid flowing from said cap open port to said open bottom, whereby hydraulic fluid applied under pressure to said valve pressure port depresses said piston to its depressed position and hydraulic fluid applied under pressure to said cap open port is restricted by the directional flow control valve for a period of time determined by a desired time delay and then flows through said channel to said open bottom and extends said piston against the force of the spring and against the force of return hydraulic fluid supplied under pressure to the cylinder return port and whereby after the lapse of the period of time said piston stem contacts the valve stem thereby causing hydraulic fluid to port from said valve pressure port to said valve cylinder port to provide high pressure hydraulic fluid flow to a hydraulic device coupled to said valve cylinder port.

2. A hydraulic time delay valve as claimed in claim 1, wherein the base member of said end cap has a flange for mounting said hydraulic time delay valve.

3. A hydraulic time delay valve as claimed in claim 1, wherein said cylinder has a top and a second cylindrical portion extending from the top coaxial with said cylinder and into the first cylindrical portion in spaced relation with said first cylindrical portion, whereby said spring is positioned around the second cylindrical portion and within the first cylindrical portion.

4. A hydraulic time delay valve as claimed in claim 3, further comprising two backup rings and an O-ring between said piston stem and the second cylindrical portion of said cylinder.

5. A hydraulic time delay valve as claimed in claim 1, further comprising a two backup rings and an O-ring between the base portion of said piston and said cylinder and a second set of two backup rings and an O-ring between said cylinder and the cylindrical projection of said end cap.

6. A hydraulic time delay valve as claimed in claim 1, further comprising a lock ring around said cylinder and the cylindrical projection of said end cap on said cylindrical projection.

* * * * *